US012402763B2

(12) United States Patent
Robinson

(10) Patent No.: US 12,402,763 B2
(45) Date of Patent: Sep. 2, 2025

(54) TOILET SEAT DISINFECTION ASSEMBLY

(71) Applicant: Robert Robinson, Tacoma, WA (US)

(72) Inventor: Robert Robinson, Tacoma, WA (US)

( * ) Notice: Subject to any disclaimer, the term of this patent is extended or adjusted under 35 U.S.C. 154(b) by 147 days.

(21) Appl. No.: 18/238,172

(22) Filed: Aug. 25, 2023

(65) Prior Publication Data

US 2025/0064276 A1 Feb. 27, 2025

(51) Int. Cl.
*A47K 17/00* (2006.01)

(52) U.S. Cl.
CPC ..... *A47K 17/00* (2013.01)

(58) Field of Classification Search
CPC ..... A47K 17/00
See application file for complete search history.

(56) References Cited

U.S. PATENT DOCUMENTS

| | | | | |
|---|---|---|---|---|
| 3,837,018 | A | 9/1974 | Haberle | |
| 4,688,275 | A | 8/1987 | Kuo | |
| 4,914,757 | A | 4/1990 | Johnson | |
| 5,813,057 | A | 9/1998 | Descent | |
| 6,299,862 | B1 | 10/2001 | Barrow | |
| 8,136,171 | B2 * | 3/2012 | Huang | A47K 13/302 4/233 |
| 8,776,278 | B1 * | 7/2014 | Dorra | A47K 13/302 4/233 |
| D734,841 | S | 7/2015 | Takayama | |
| 10,385,560 | B2 | 8/2019 | Shen | |
| 10,563,388 | B2 | 2/2020 | Nogoshi | |
| 12,099,951 | B2 * | 9/2024 | Mahaffey | G06Q 10/0633 |
| 2003/0046754 | A1 * | 3/2003 | Pellati | A47K 13/302 4/233 |
| 2009/0133185 | A1 | 5/2009 | Fisseha | |
| 2022/0112704 | A1 * | 4/2022 | Garrels | B03C 3/49 |

FOREIGN PATENT DOCUMENTS

| | | |
|---|---|---|
| WO | WO9914443 | 3/1999 |

* cited by examiner

*Primary Examiner* — Christine J Skubinna

(57) ABSTRACT

A toilet seat disinfection assembly includes a disinfectant reservoir that is mountable to a toilet and which contains a liquid disinfectant. A disinfectant unit is mountable to a toilet and the disinfectant unit includes a blower and a sprayer. Each of the blower and the sprayer is urgeable between a deployed position and a stored position. The sprayer sprays the liquid disinfectant onto a seat of the toilet when the spray is urged into the deployed position to disinfect the toilet seat thereby ensuring a clean and sterile toilet seat for subsequent use. The blower is actuated into the deployed position when the sprayer is actuated into the stored position to urge air onto the toilet seat for drying the toilet seat.

11 Claims, 10 Drawing Sheets

TOILET SEAT DISINFECTION ASSEMBLY

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

The disclosure relates to disinfection devices and more particularly pertains to a new disinfection device for automatically sterilizing a toilet seat. The device includes a disinfectant reservoir, mounted to a toilet, which contains a liquid disinfectant and a disinfectant unit that is mounted the toilet and which is fluidly coupled to the disinfectant reservoir. A sprayer is movably integrated into the disinfectant unit and a blower is movably integrated into the disinfectant unit. The sprayer is actuated to spray disinfectant onto the toilet seat when the toilet is flushed and the blower is actuated to blow air onto the toilet seat to dry the toilet seat when the sprayer sprays the disinfectant onto the toilet seat.

(2) Description of Related Art Including Information Disclosed Under 37 CFR 1.97 and 1.98

The prior art relates to disinfection devices including a variety of toilet sterilizing devices that each includes a mechanized element for physical cleaning a toilet and a plurality of toilet sterilizing devices that each releases a chemical disinfectant into water employed by a toilet and a variety of toilet sterilizing devices that each applies a liquid disinfectant to a toilet seat. In no instance does the prior art disclose a toilet sterilizing device that includes a sprayer that is urgeable into a deployed position to spray a disinfectant onto a toilet seat and a blower that is urgeable into a deployed position to blow air onto the toilet seat to dry the toilet seat when the disinfectant has been sprayed onto the toilet seat.

BRIEF SUMMARY OF THE INVENTION

An embodiment of the disclosure meets the needs presented above by generally comprising a disinfectant reservoir that is mountable to a toilet and which contains a liquid disinfectant. A disinfectant unit is mountable to a toilet and the disinfectant unit includes a blower and a sprayer. Each of the blower and the sprayer is urgeable between a deployed position and a stored position. The sprayer sprays the liquid disinfectant onto a seat of the toilet when the spray is urged into the deployed position to disinfect the toilet seat thereby ensuring a clean and sterile toilet seat for subsequent use. The blower is actuated into the deployed position when the sprayer is actuated into the stored position to urge air onto the toilet seat for drying the toilet seat.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
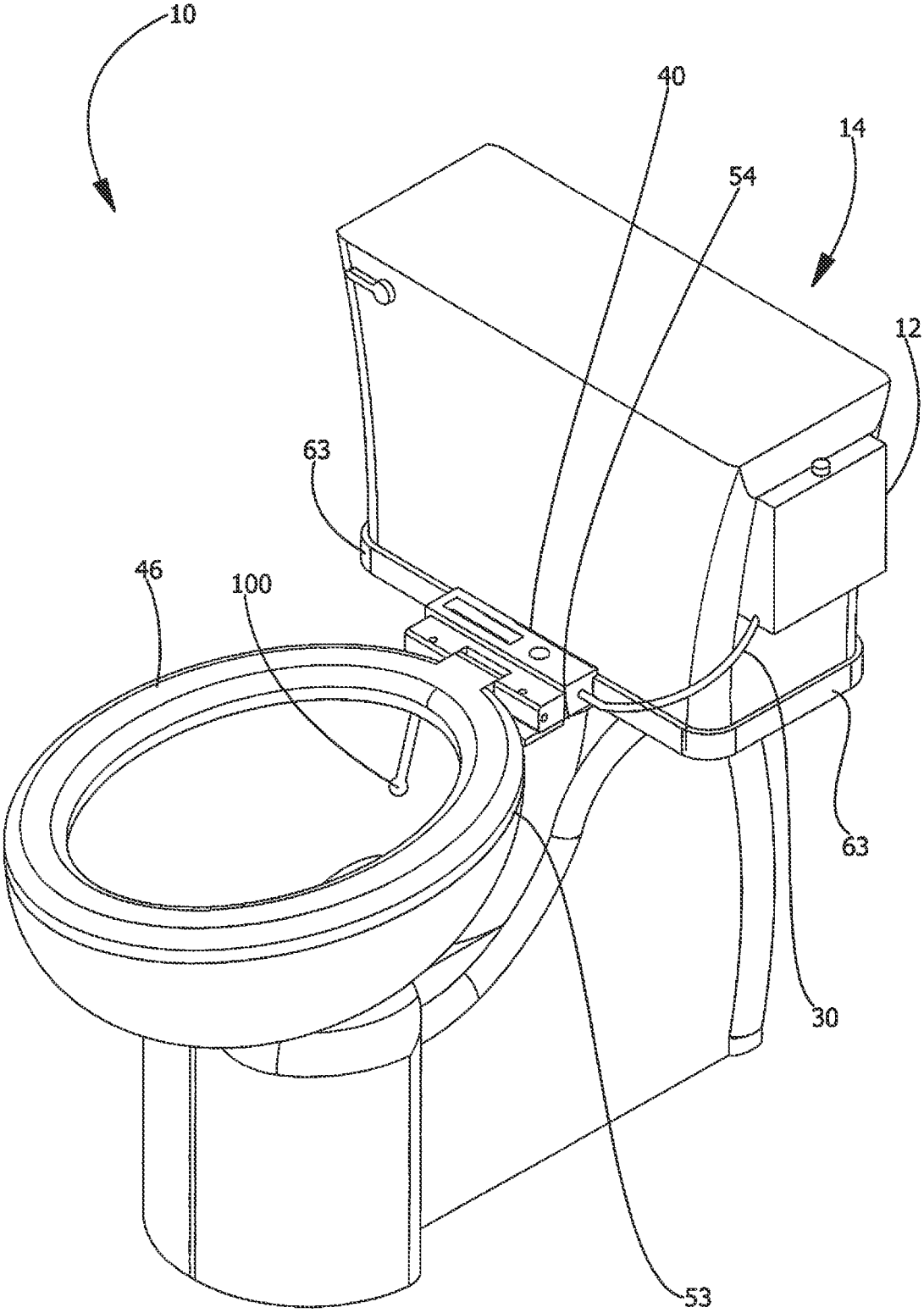
FIG. 1 is a perspective view of a toilet seat disinfection assembly according to an embodiment of the disclosure.
Figure 2:
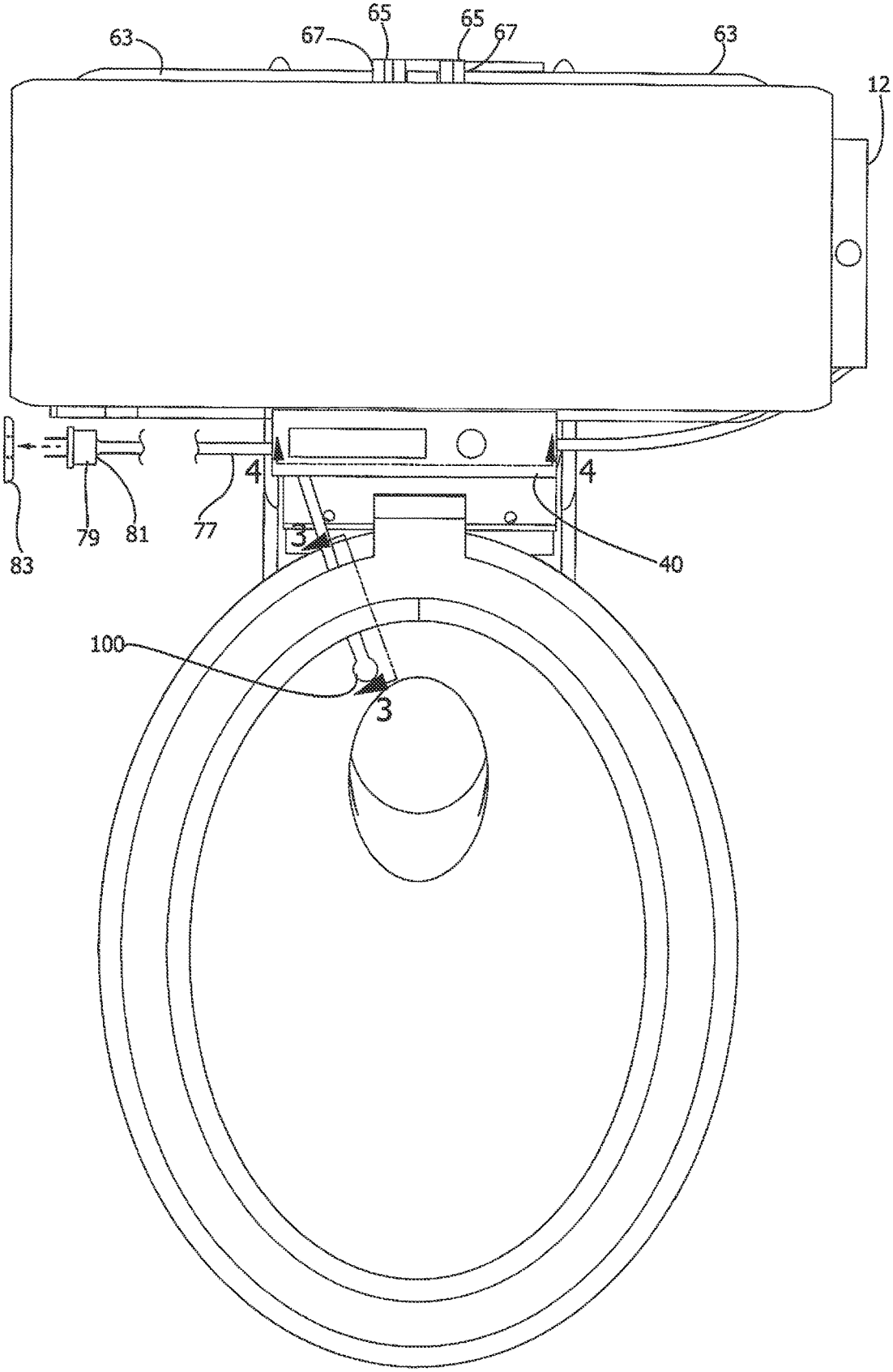
FIG. 2 is a top view of an embodiment of the disclosure.
Figure 3:
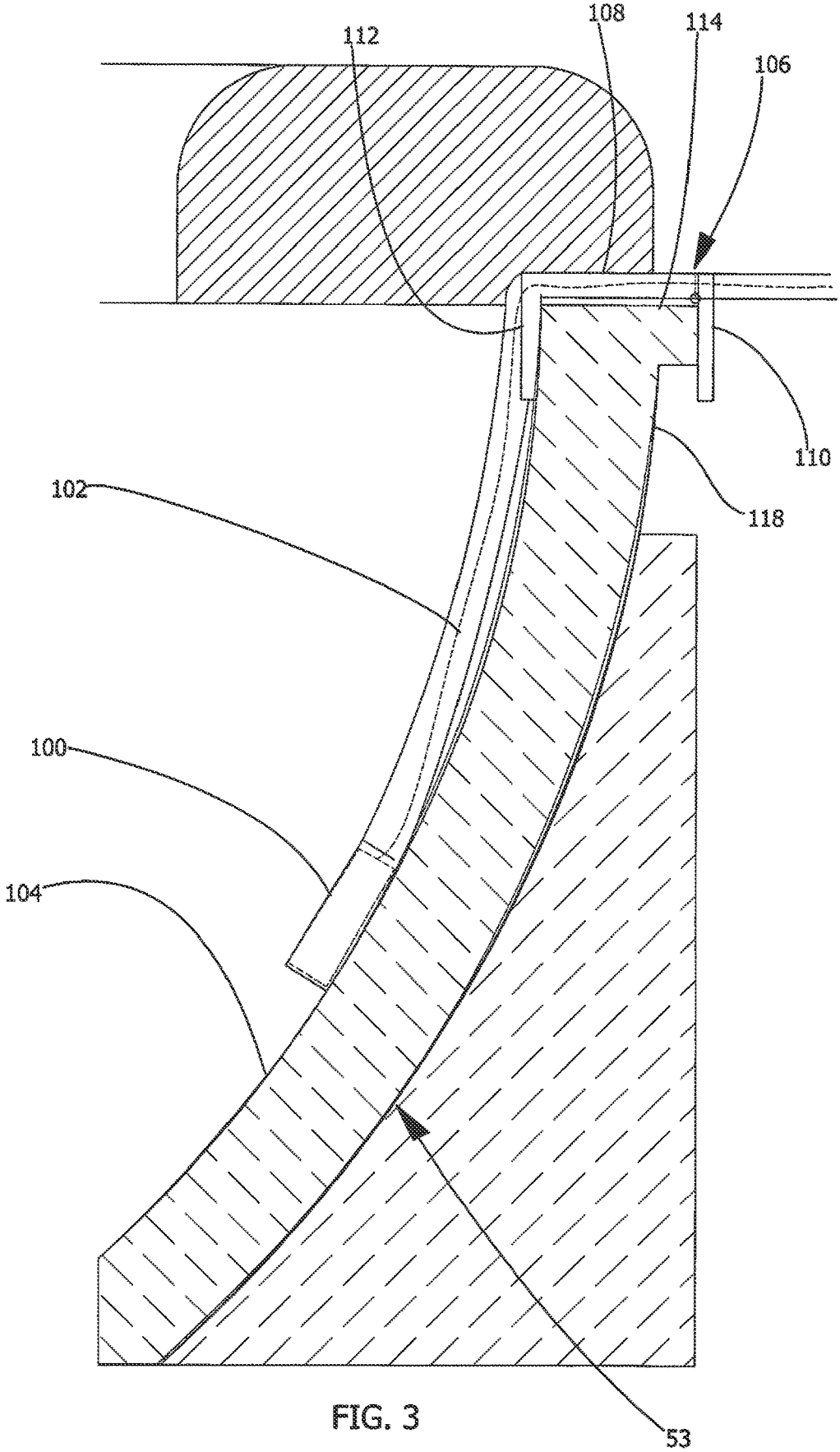
FIG. 3 is a cross sectional view taken along line 3-3 of FIG. 2 of an embodiment of the disclosure.
Figure 4:
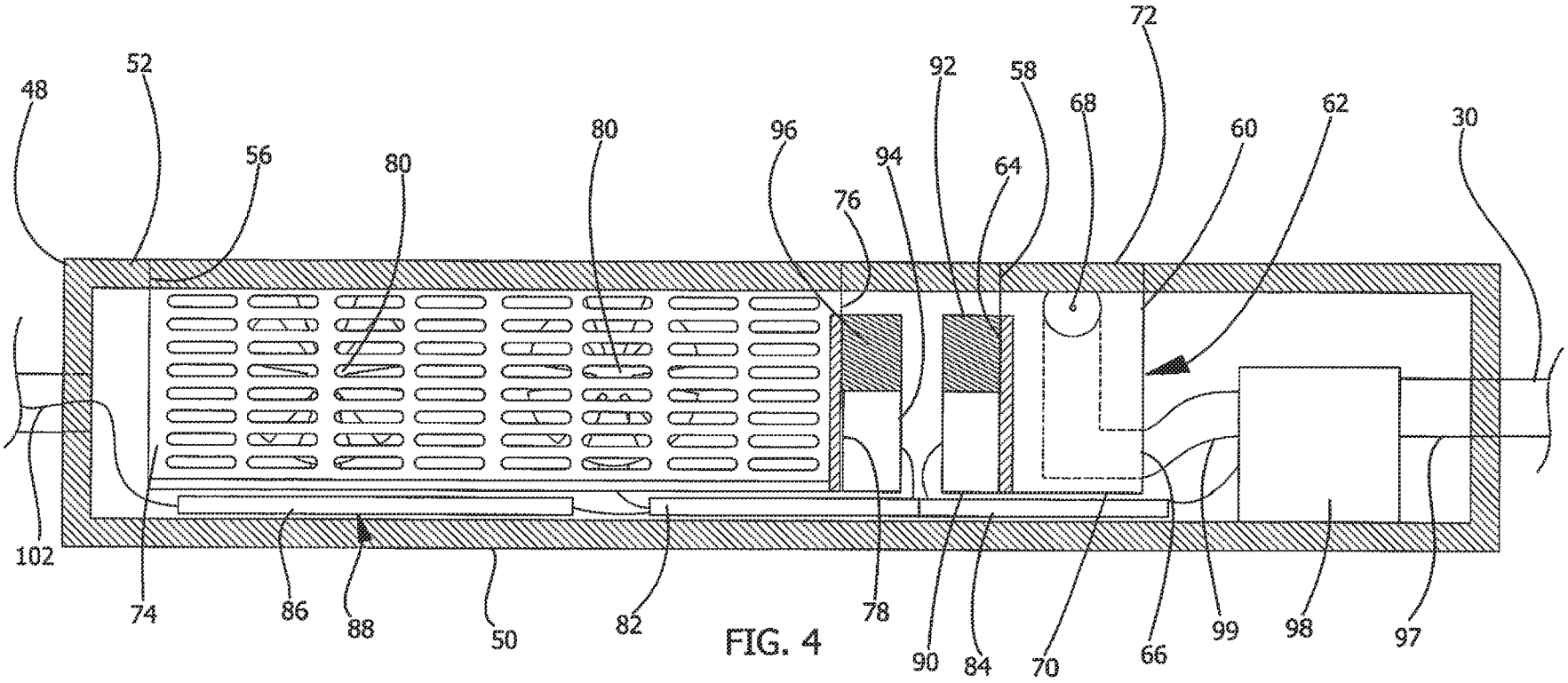
FIG. 4 is a cross sectional view taken along line 4-4 of FIG. 2 of an embodiment of the disclosure.
Figure 5:
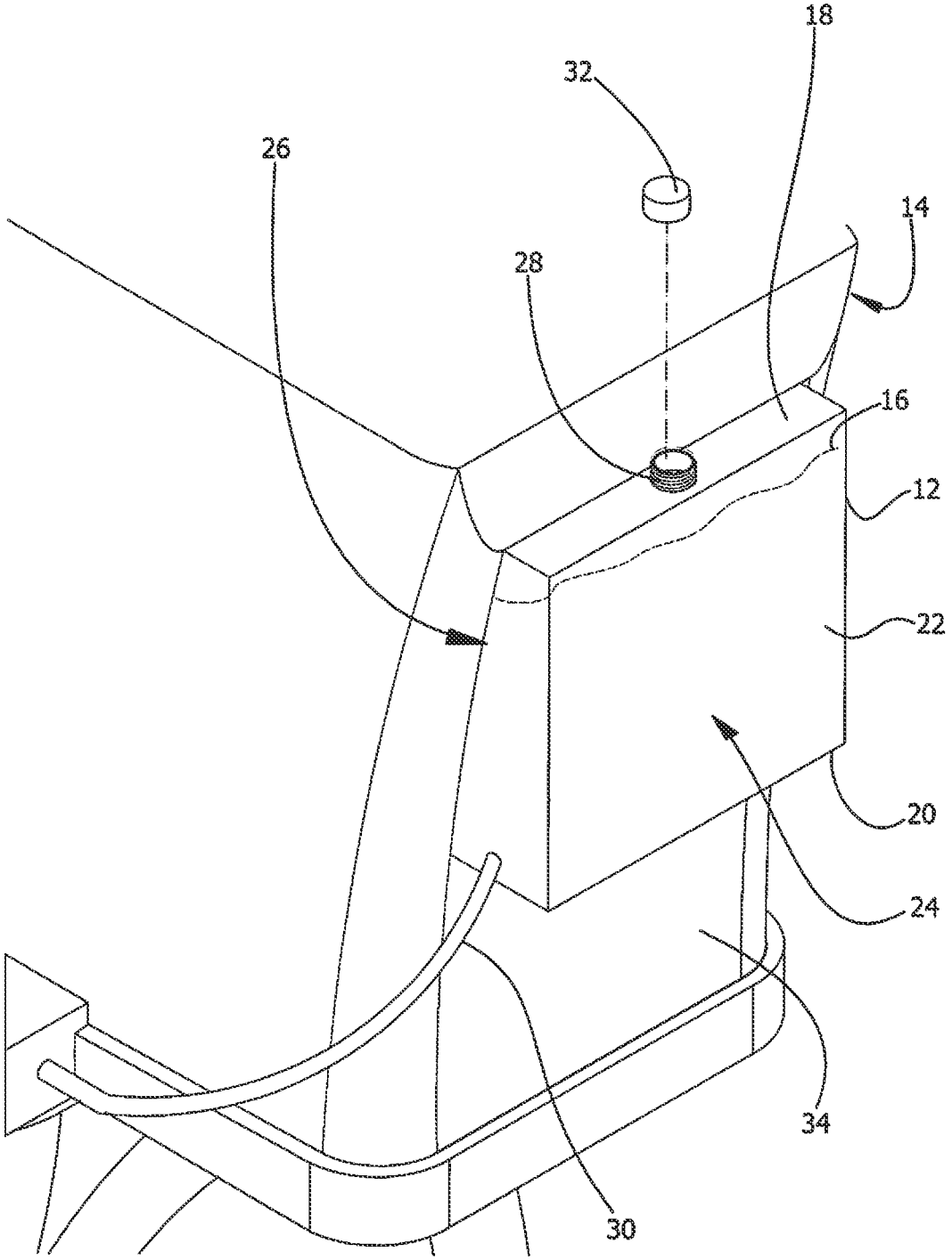
FIG. 5 is a perspective view of disinfectant reservoir of an embodiment of the disclosure.
Figure 6:
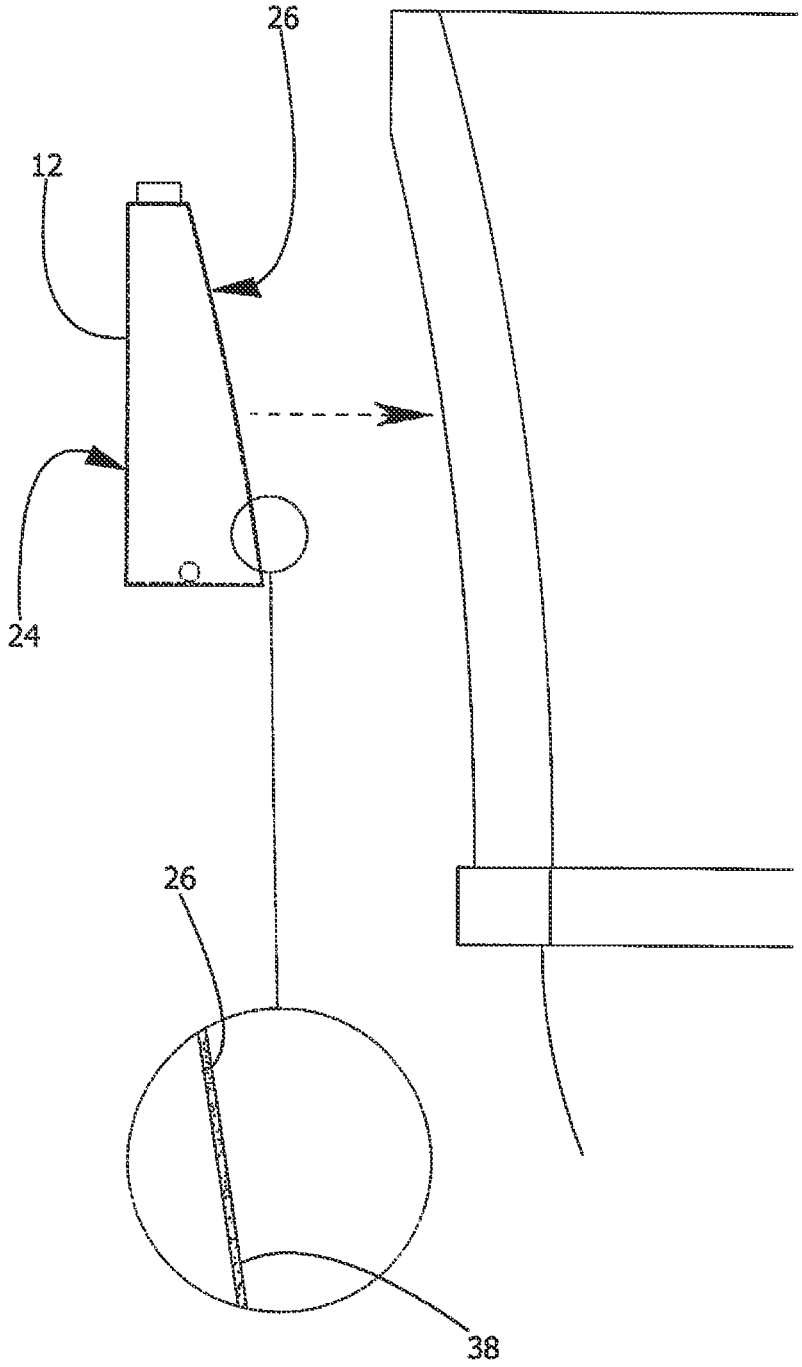
FIG. 6 is an exploded perspective view of disinfectant reservoir of an embodiment of the disclosure.
Figure 7:
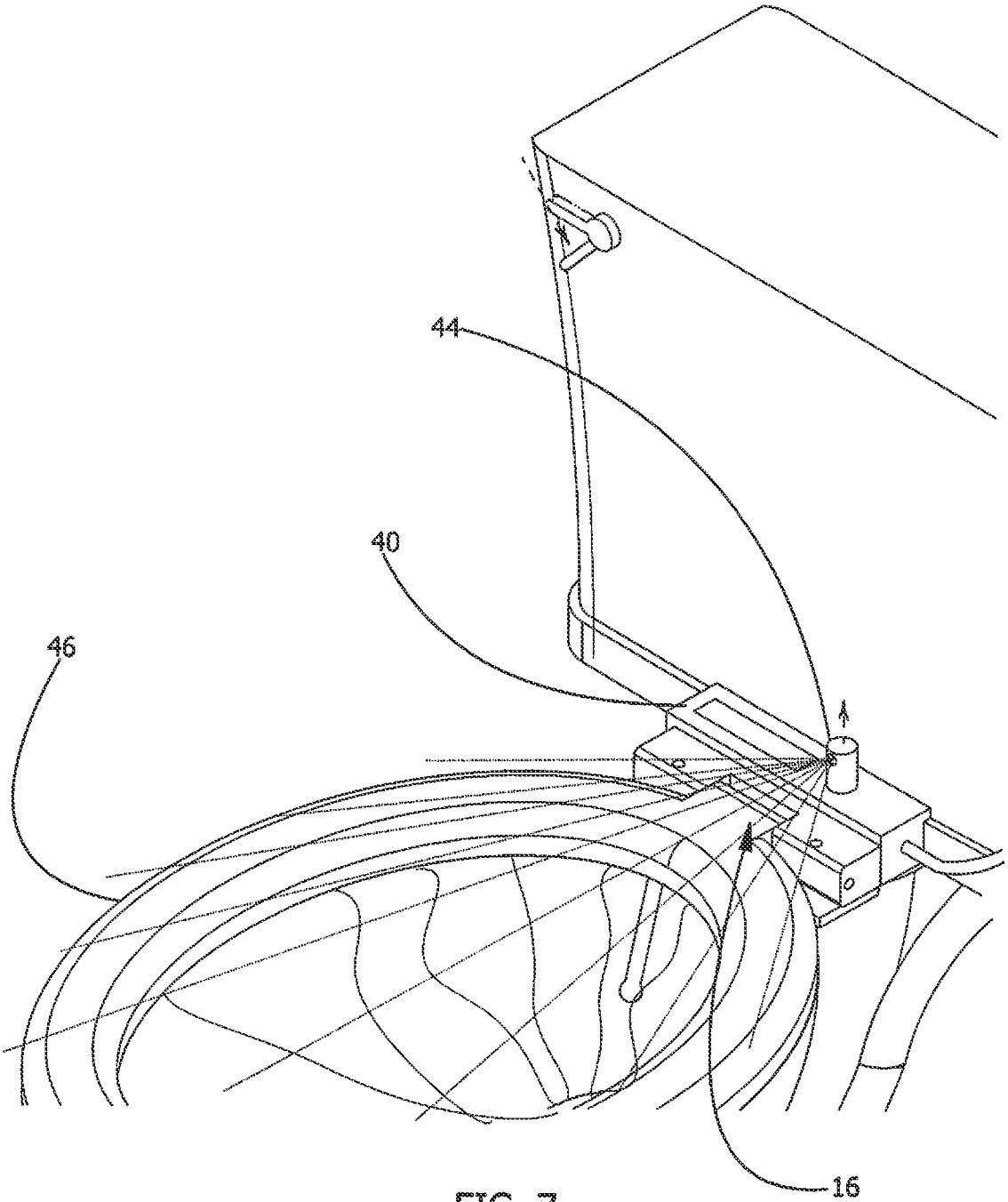
FIG. 7 is a perspective in-use view of an embodiment of the disclosure showing a sprayer spraying liquid disinfectant onto a toilet seat.
Figure 8:
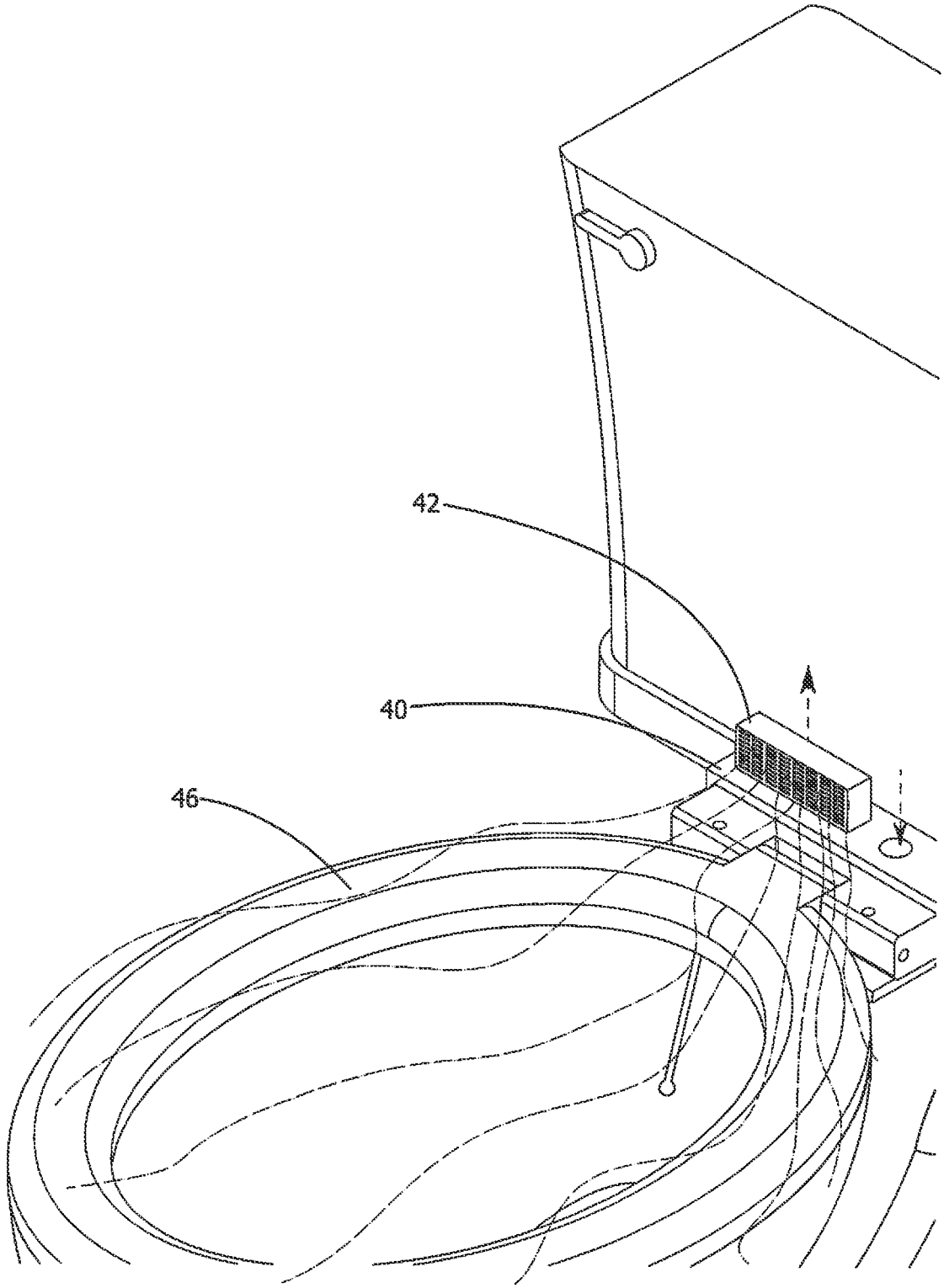
FIG. 8 is a perspective in-use view of an embodiment of the disclosure showing a blower blowing air into a toilet seat.

With reference now to the drawings, and in particular to FIGS. 1 through 10 thereof, a new disinfection device embodying the principles and concepts of an embodiment of the disclosure and generally designated by the reference numeral 10 will be described.

As best illustrated in FIGS. 1 through 10, the toilet seat disinfection assembly 10 generally comprises a disinfectant reservoir 12 that is mountable to a toilet 14 and the disinfectant reservoir 12 contains a liquid disinfectant 16. The toilet 14 may be a plumbed toilet of any conventional design that would commonly be found in a public restroom, for example, or any other bathroom such as a bathroom in a residence. The disinfectant reservoir 12 has a top wall 18, a bottom wall 20 and an outer wall 22 extending between the top wall 18 and the bottom wall 20 and the outer wall 22 has a front side 24 and a back side 26. The back side 26 angles toward the front side 24 between the bottom wall 20 and the top wall 18 such that the disinfectant reservoir 12 has a trapezoidal shape.

The top wall 18 has a fill port 28 extending into an interior of the disinfectant reservoir 12 for filling the disinfectant reservoir 12 with the liquid disinfectant 16. Additionally, the disinfectant reservoir 12 has an outlet tube 30 that is fluidly integrated into the outer wall 22 at a point located adjacent to the bottom wall 20 thereby facilitating the outlet tube 30 to transport the liquid disinfectant 16 outwardly from the disinfectant reservoir 12. The disinfectant reservoir 12 includes a cap 32 which removably engages the fill port 28 for opening or closing the fill port 28. The back side 26 of the outer wall 22 rests against an exterior wall 34 of a tank 36 of the toilet 14 and an adhesive layer 38 is bonded to the back side 26 of the outer wall 22 of the disinfectant reservoir 12. Furthermore, the adhesive layer 38 adheres to the exterior wall 34 of the tank 36 for retaining the disinfectant reservoir 12 on the tank 36.

A disinfectant unit 40 is mountable to a toilet 14 and the disinfectant unit 40 includes a blower 42 and a sprayer 44 and each of the blower 42 and the sprayer 44 is urgeable between a deployed position and a stored position. The sprayer 44 is in fluid communication with the disinfectant reservoir 12 thereby facilitating the sprayer 44 to spray the liquid disinfectant 16 onto a seat 46 of the toilet 14 when the sprayer 44 is urged into the deployed position. In this way the sprayer 44 can disinfect the toilet seat 46 thereby ensuring a clean and sterile toilet seat 46 for subsequent use. The blower 42 is actuated into the deployed position when the sprayer 44 is actuated into the stored position thereby facilitating the blower 42 to urge air onto the toilet seat 46 for drying the toilet seat 46.

The disinfectant unit 40 comprises a housing 48 that has a lower wall 50 and an upper wall 52 and the lower wall 50 is mounted to an upper surface 54 of the bowl 53 of the toilet 14 having the housing 48 being positioned against the tank 36. The upper wall 52 has a blower opening 56 extending into an interior of the housing 48 and the upper wall 52 has a sprayer opening 58 extending into the interior of the housing 48. The disinfectant unit 40 includes a pair of belts 63 each being coupled to and extending laterally away from the housing 48 in opposite directions from each other. As is most clearly shown in FIG. 2, each of the belts 63 includes a buckle 65 that is attached to a distal end 67 of a respective belt 63 and the buckle 65 on each belt 63 is matable to each other for securing the belts 63 around the tank to secure the housing 48 to the tank 36.

The sprayer 44 comprises a cylinder 60 that is slidably positioned within the housing 48 and the cylinder 60 is aligned with the sprayer opening 58. The cylinder 60 has an outside wall 62 and the cylinder 60 has a first rail gear 64 that is integrated into the outside wall 62 and the first rail gear 64 is vertically oriented on the outside wall 62. The cylinder 60 has a sprayer inlet 66 that is integrated into the outside wall 62 and a sprayer outlet 68 that is integrated into the outside wall 62. The sprayer outlet 68 is in fluid communication with the sprayer inlet 66 and the sprayer inlet 66 is positioned adjacent to a lower end 70 of the cylinder 60. Additionally, the sprayer outlet 68 is positioned adjacent to an upper end 72 of the cylinder 60.

The blower 42 has a front wall 74 and a lateral wall 76 and the blower 42 is aligned with the blower opening 56 in the top wall 18 of the housing 48; the front wall 74 is foraminous to pass air through the front wall 74. A second rail gear 78 that is integrated into the lateral wall 76 and the second rail gear 78 is vertically oriented on the lateral wall 76. The blower 42 includes a plurality of fans 80 each positioned within the blower 42 and each of the plurality of fans 80 blows air outwardly through the front wall 74 when the fans 80 are turned on. Each of the fans 80 may include an electric motor and a plurality of blades that are rotated by the electric motor.

The disinfectant unit 40 includes a processor 82 that is integrated into the housing 48. The processor 82 receives a blower deploy input, a blower retract input, a sprayer deploy input and a sprayer retract input. The disinfectant unit 40 includes an electronic timer 84 that is integrated into the housing 48 and the electronic timer 84 is electrically coupled to the processor 82. The electronic timer 84 is actuated to countdown a first duration of time when the processor 82 receives the sprayer deploy input. Furthermore, the processor 82 receives the sprayer retract input when the electronic timer 84 completes counting down the first duration of time. The disinfectant unit 40 includes a power supply 86 positioned within the housing 48. The power supply 86 is electrically coupled to the processor 82 and the power supply 86 comprises at least one battery 88. As is most clearly shown in FIG. 2, the power supply 86 may include a power cord 77 which has a male plug 79 disposed on a distal end 81 of the power cord 77 which can be plugged into a power source 83 comprising a female electrical outlet.

The electronic timer 84 is actuated to countdown a second duration of time when the processor 82 receives the blower deploy input. Additionally, the processor 82 receives the blower deploy input when the electronic timer 84 finishes counting down the first duration of time. The processor 82 receives the blower retract input when the electronic timer 84 finishes counting down the second duration of time. The first duration of time may range between approximately 2.0 seconds and 5.0 seconds and the second duration of time may range between approximately 30.0 seconds and 60.0 seconds.

The disinfectant unit 40 includes a first motor 90 that is positioned within the housing 48 and the first motor 90 is electrically coupled to the processor 82. Additionally, the first motor 90 is positioned adjacent to the cylinder 60 associated with the sprayer 44. The first motor 90 is actuated to rotate in a first direction when the processor 82 receives the sprayer deploy input. Conversely, the first motor 90 is actuated to rotate in a second direction when the processor 82 receives the sprayer retract input. The disinfectant unit 40 includes a first gear 92 that is rotatably attached to the first motor 90 and the first gear 92 enmeshes with the first rail gear 64 which is integrated into the cylinder 60. The cylinder 60 is lifted upwardly through the sprayer opening 58 in the upper wall 52 of the housing 48 when the first motor 90 rotates in the first direction. Conversely, the cylinder 60 is lowered through the sprayer opening 58 having the cylinder 60 contained within the housing 48 when the first motor 90 rotates in the second direction. The first motor 90 may comprise a two direction electric motor or the like.

The disinfectant unit 40 includes a second motor 94 that is positioned within the housing 48 and the second motor 94 is electrically coupled to the processor 82. Additionally, the second motor 94 is positioned adjacent to the lateral wall 76 of the blower 42. The second motor 94 is actuated to rotate in a second direction when the processor 82 receives the blower deploy input. Conversely, the second motor 94 is actuated to rotate in a second direction when the processor 82 receives the blower retract input. The second motor 94 may comprise a two direction electric motor or the like.

A second gear 96 is rotatably attached to the second motor 94 and the second gear 96 enmeshes with the second rail gear 78 which is integrated into the lateral wall 76 of the blower 42. The blower 42 is lifted upwardly through the blower opening 56 in the upper wall 52 of the housing 48 when the second motor 94 rotates in the second direction. Conversely, the blower 42 is lowered through the blower opening 56 having the blower 42 being contained within the housing 48 when the second motor 94 rotates in the second direction. Each of the plurality of fans 80 in the blower 42 is turned on when the processor 82 receives the blower deploy input. Conversely, each of the plurality of fans 80 is turned off when the processor 82 receives the blower retract input.

The disinfectant unit 40 includes a pump 98 that is positioned within the housing 48 and the pump 98 is electrically coupled to the processor 82. The pump 98 has an input 97 and an output 99 and the input 97 is fluidly coupled to the outlet tube 30 of the disinfectant reservoir 12 such that the pump 98 receives the liquid disinfectant 16. The output 99 is fluidly coupled to the sprayer inlet 66 on the cylinder 60 associated with the sprayer 44. The pump 98 is actuated when the processor 82 receives the sprayer deploy input such that the pump 98 urges the liquid disinfectant 16 outwardly through the sprayer outlet 68 in the cylinder 60 associated with the sprayer 44. Additionally, the sprayer outlet 68 is directed toward the seat 46 of the toilet 14 when the cylinder 60 associated with the sprayer 44 is cylinder 60 is lifted upwardly thereby facilitating the sprayer outlet 68 to spray the liquid disinfectant 16 onto the toilet seat 46. The pump 98 is de-actuated when the processor 82 receives the sprayer retract input and the pump 98 may comprise an electric fluid pump or the like.

A flush sensor 100 is mountable to a toilet 14 having the flush sensor 100 being positioned in a bowl 53 of the toilet 14 thereby facilitating the flush sensor 100 to be exposed to water when the toilet 14 is flushed. The flush sensor 100 includes a conductor 102 that is electrically coupled between the flush sensor 100 and the processor 82 in the housing 48 associated with the disinfectant unit 40. Additionally, the flush sensor 100 rests against an interior surface 104 of the bowl 53 and the processor 82 receives the sprayer deploy input when the flush sensor 100 senses water. The flush sensor 100 may comprise an electronic fluid sensor or the like that can sense the presence of water.

A clip 106 is included which has a central member 108 hingedly coupled to and being perpendicularly oriented with a first member 110 and a second member 112 being perpendicularly oriented with the central member 108 such that the second member 112 is spaced from the first member 110. The central member 108 rests on top of a rim 114 of the bowl 53 such that each of the first member 110 and the second member 112 extends downwardly along a respective interior surface 104 and an outwardly facing surface 118 of the bowl 53. Additionally, the conductor 102 associated with flush sensor 100 is attached to the clip 106 thereby facilitating the clip 106 to mount the conductor 102 to the bowl 53.

Figure 9:
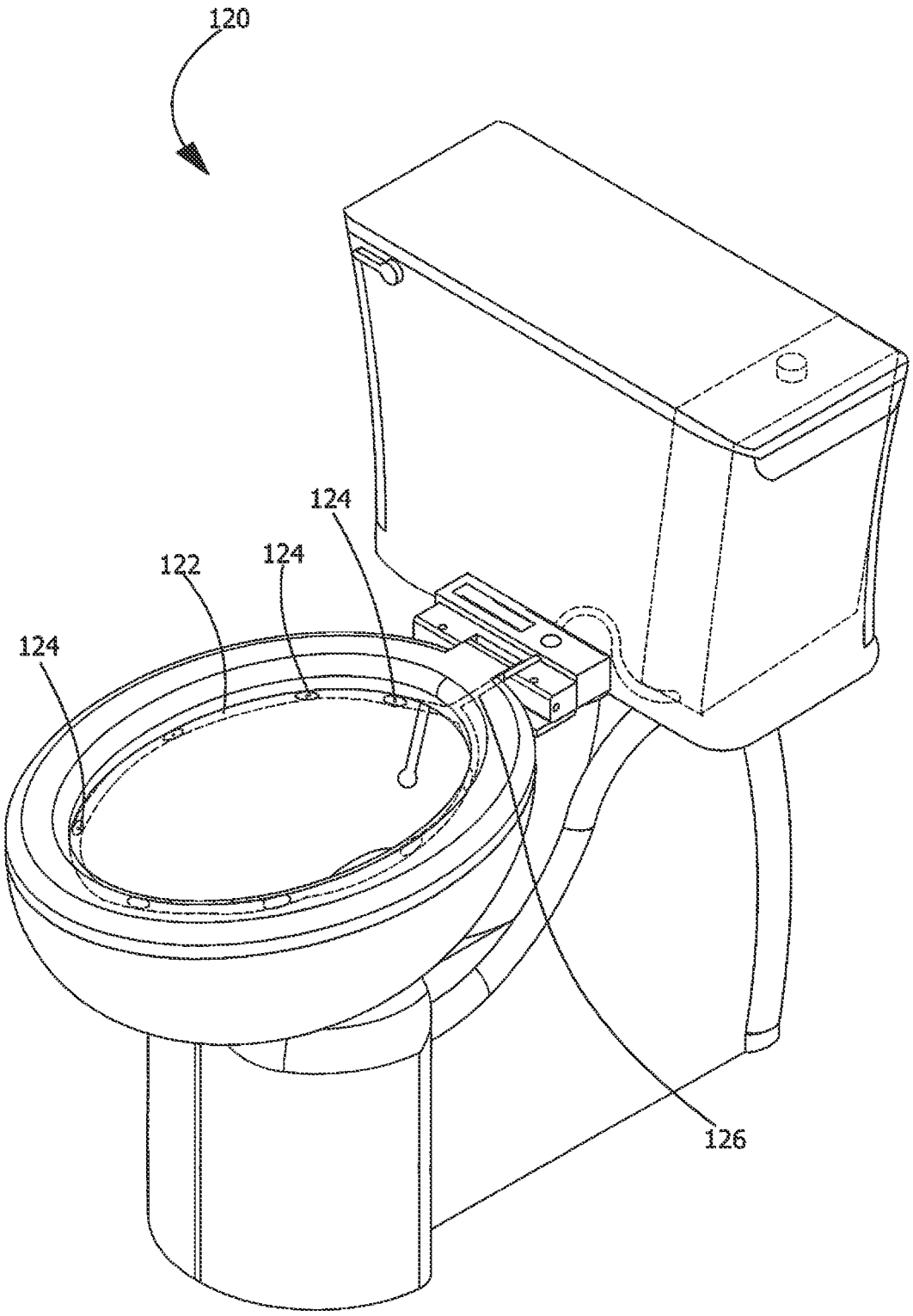
FIG. 9 is a perspective view of an alternative embodiment of the disclosure.
Figure 10:
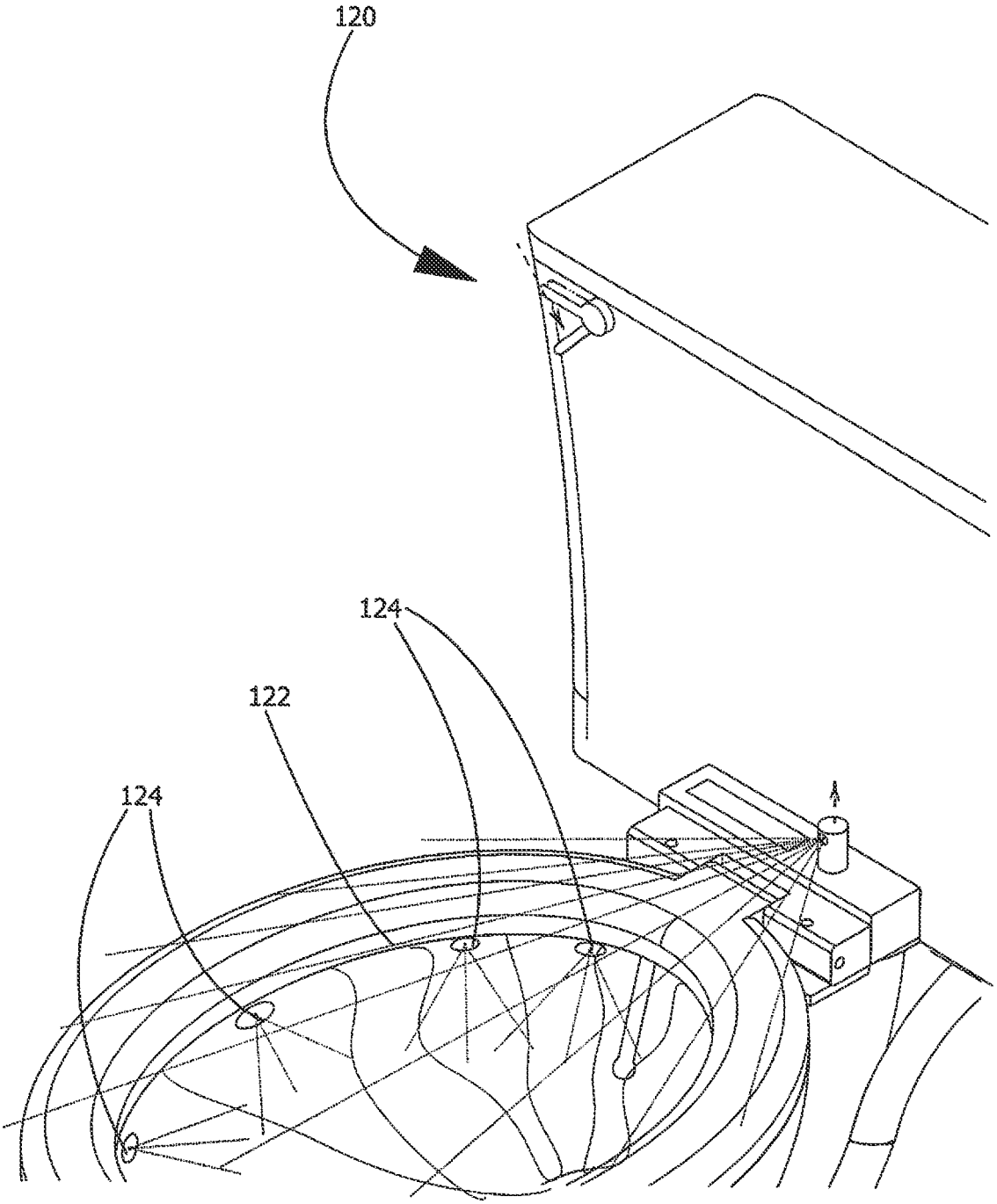
FIG. 10 is a perspective in-use view of an alternative embodiment of the disclosure.

In an alternative embodiment 120 as is most clearly shown in FIGS. 9 and 10, the disinfectant reservoir 12 is a unitary structure of the tank 36 of the toilet 14. Continuing in the alternative embodiment 120, a spray tube 122 is provided that is continuous such that the spray tube 122 defines a closed loop. The spray tube 122 is positioned on the interior surface 104 of the bowl 53 having the spray tube 122 extending around a full perimeter of the interior surface 104. The spray tube 122 has a plurality of spray nozzles 124 that are distributed around a full perimeter of the spray tube 122. The spray tube 122 is oriented such that each of the spray nozzles 124 is directed into an interior of the bowl 53. The alternative embodiment 120 includes a supply tube 126 that is fluidly coupled between the spray tube 122 and the output 99 of the pump 98 thereby facilitating the spray tube 122 to spray the liquid disinfectant 16 into the bowl 53 when the pump 98 is turned on.

In use, the disinfectant reservoir 12 and the disinfectant unit 40 and the flush sensor 100 are each mounted to the toilet 14 in the aforementioned locations on the toilet 14. The sprayer 44 is actuated into the deployed position when the toilet 14 is flushed to spray the liquid disinfectant 16 onto the toilet seat 46. The sprayer 44 is actuated into the stored position and the blower 42 is actuated into the deployed position. The blower 42 is turned on the blow air onto the toilet seat 46 to dry the toilet seat 46. The blower 42 is turned off and the blower 42 is actuated into the stored position when the blower 42 has been turned for a sufficient duration of time to dry the toilet seat 46. In this way the toilet seat 46 is automatically disinfected and dried each time the toilet 14 is flushed thereby ensuring a clean and a sanitary toilet seat 46 for subsequent use.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A toilet seat disinfection assembly for disinfecting a toilet seat each time a toilet is flushed, said assembly comprising:

a disinfectant reservoir being mountable to a toilet, said disinfectant reservoir containing a liquid disinfectant;

a disinfectant unit being mountable to a toilet, said disinfectant unit including a blower and a sprayer, each of said blower and said sprayer being urgeable between a deployed position and a stored position, said sprayer being in fluid communication with said disinfectant reservoir thereby facilitating said sprayer to spray said liquid disinfectant onto a seat of said toilet when said spray is urged into said deployed position wherein said sprayer is configured to disinfect said toilet seat thereby ensuring a clean and sterile toilet seat for subsequent use, said blower being actuated into said deployed position when said sprayer is actuated into said stored position wherein said blower is configured to urge air onto said toilet seat for drying said toilet seat;

a flush sensor being mountable to a toilet having said flush sensor being positioned in a bowl of said toilet thereby facilitating said flush sensor to be exposed to water when said toilet is flushed, said flush sensor being in communication with said disinfectant unit such that said sprayer and said blower are actuated into said deployed position when said flush sensor senses water;

wherein said disinfectant unit comprises a housing having a lower wall and an upper wall, said lower wall being mounted to an upper surface of said bowl of said toilet having said housing being positioned against said tank;

wherein said upper wall has a blower opening extending into an interior of said housing;

wherein said upper wall has a sprayer opening extending into said interior of said housing;

wherein said sprayer comprises a cylinder being slidably positioned within said housing, said cylinder being aligned with said sprayer opening; and wherein said blower is aligned with said blower opening in said top wall of said housing.

2. The assembly according to claim 1, wherein:

said disinfectant reservoir has a top wall, a bottom wall and an outer wall extending between said top wall and said bottom wall;

said outer wall has a front side and a back side, said back side angling toward said front side between said bottom wall and said top wall such that said disinfectant reservoir has a trapezoidal shape, said back side of said outer wall resting against an exterior wall of a tank of said toilet;

said top wall has a fill port extending into an interior of said disinfectant reservoir for filling said disinfectant reservoir with said liquid disinfectant;

said disinfectant reservoir has an outlet tube being fluidly integrated into said outer wall at a point located adjacent to said bottom wall thereby facilitating said outlet tube to transport said liquid disinfectant outwardly from said disinfectant reservoir;

said disinfectant reservoir includes a cap which removably engages said fill port for opening or closing said fill port; and said assembly includes an adhesive layer being bonded to said back side of said outer wall of said disinfectant reservoir, said adhesive layer adhering to said exterior wall of said tank for retaining said disinfectant reservoir on said tank.

3. The assembly according to claim 1, wherein:

said cylinder has an outside wall;

said cylinder has a first rail gear being integrated into said outside wall, said first rail gear being vertically oriented on said outside wall;

said cylinder has a sprayer inlet being integrated into said outside wall and a sprayer outlet being integrated into said outside wall;

said sprayer outlet being in fluid communication with said sprayer inlet;

said sprayer inlet is positioned adjacent to a lower end of said cylinder; and said sprayer outlet is positioned adjacent to an upper end of said cylinder.

4. The assembly according to claim 1, wherein:

said blower has a front wall and a lateral wall;

said front wall is foraminous wherein said front wall is configured to pass air through said front wall;

said blower has a second rail gear being integrated into said lateral wall, said second rail gear being vertically oriented on said lateral wall; and said blower includes a plurality of fans each being positioned within said blower wherein each of said plurality of fans is configured to blow air outwardly through said front wall when said fans are turned on.

5. The assembly according to claim 1, wherein:

said disinfectant unit includes a processor being integrated into said housing, said processor receiving a blower deploy input and a blower retract input and a sprayer deploy input and a sprayer retract input;

said disinfectant unit includes an electronic timer being integrated into said housing, said electronic timer being electrically coupled to said processor;

said electronic timer is actuated to countdown a first duration of time when said processor receives said sprayer deploy input, said processor receiving said sprayer retract input when said electronic timer completes counting down said first duration of time;

said electronic timer is actuated to countdown a second duration of time when said processor receives said blower deploy input;

said processor receives said blower deploy input when said electronic timer finishes counting down said first duration of time; and said processor receives said blower retract input when said electronic timer finished counting down said second duration of time.

6. The assembly according to claim 5, wherein;

said cylinder associated with said sprayer has a first rail gear being integrated into an outside wall of said cylinder; and said disinfectant unit includes:

a first motor being positioned within said housing, said first motor being electrically coupled to said processor, said first motor being positioned adjacent to said cylinder associated with said sprayer, said first motor being actuated to rotate in a first direction when said processor receives said sprayer deploy input, said first motor being actuated to rotate in a second direction when said processor receives said sprayer retract input; and a first gear being rotatably attached to said first motor, said first gear enmeshing with said first rail gear which is integrated into said cylinder, said cylinder being lifted upwardly through said sprayer opening in said upper wall of said housing when said first motor rotates in said first direction, said cylinder being lowered through said sprayer opening having said cylinder being contained within said housing when said first motor rotates in said second direction.

7. The assembly according to claim 5, wherein;

said blower has a second rail gear being integrated into a lateral wall of said blower; and said disinfectant unit includes:

a second motor being positioned within said housing, said second motor being electrically coupled to said processor, said second motor being positioned adjacent to said lateral wall of said blower, said second motor being actuated to rotate in a second direction when said processor receives said blower deploy input, said second motor being actuated to rotate in a second direction when said processor receives said blower retract input; and a second gear being rotatably attached to said second motor, said second gear enmeshing with said second rail gear which is integrated into said lateral wall of said blower, said blower being lifted upwardly through said blower opening in said upper wall of said housing when said second motor rotates in said second direction, said blower being lowered through said blower opening having said blower being contained within said housing when said second motor rotates in said second direction, each of said plurality of fans in said blower being turned on when said processor receives said blower deploy input, each of said plurality of fans being turned off when said processor receives said blower retract input.

8. The assembly according to claim 5, wherein:

said disinfectant unit includes a pump being positioned within said housing, said pump being electrically coupled to said processor;

said pump has an input and an output, said input being fluidly coupled to said outlet tube of said disinfectant reservoir such that said pump receives said liquid disinfectant, said output being fluidly coupled to said sprayer inlet on said cylinder associated with said sprayer;

said pump is actuated when said processor receives said sprayer deploy input such that said pump urges said liquid disinfectant outwardly through said sprayer outlet in said cylinder associated with said sprayer;

said sprayer outlet is directed toward said seat of said toilet when said cylinder associated with said sprayer is cylinder is lifted upwardly thereby facilitating said sprayer outlet to spray said liquid disinfectant onto said toilet seat; and said pump is de-actuated when said processor receives said sprayer retract input.

9. The assembly according to claim 5, wherein said flush sensor includes a conductor being electrically coupled between said flush sensor and said processor in said housing associated with said disinfectant unit, said flush sensor resting against an interior surface of said bowl, said processor receiving said sprayer deploy input when said flush sensor senses water.

10. A toilet seat disinfection assembly for disinfecting a toilet seat each time a toilet is flushed, said assembly comprising:

a disinfectant reservoir being mountable to a toilet, said disinfectant reservoir containing a liquid disinfectant, said disinfectant reservoir having a top wall, a bottom wall and an outer wall extending between said top wall and said bottom wall, said outer wall having a front side and a back side, said back side angling toward said front side between said bottom wall and said top wall such that said disinfectant reservoir has a trapezoidal shape, said top wall having a fill port extending into an interior of said disinfectant reservoir for filling said disinfectant reservoir with said liquid disinfectant, said back side of said outer wall resting against an exterior wall of a tank of said toilet, said disinfectant reservoir having an outlet tube being fluidly integrated into said outer wall at a point located adjacent to said bottom wall thereby facilitating said outlet tube to transport said liquid disinfectant outwardly from said disinfectant reservoir, said disinfectant reservoir including a cap which removably engages said fill port for opening or closing said fill port;

an adhesive layer being bonded to said back side of said outer wall of said disinfectant reservoir, said adhesive layer adhering to said exterior wall of said tank for retaining said disinfectant reservoir on said tank;

a disinfectant unit being mountable to a toilet, said disinfectant unit including a blower and a sprayer, each of said blower and said sprayer being urgeable between a deployed position and a stored position, said sprayer being in fluid communication with said disinfectant reservoir thereby facilitating said sprayer to spray said liquid disinfectant onto a seat of said toilet when said spray is urged into said deployed position wherein said sprayer is configured to disinfect said toilet seat thereby ensuring a clean and sterile toilet seat for subsequent use, said blower being actuated into said deployed position when said sprayer is actuated into said stored position wherein said blower is configured to urge air onto said toilet seat for drying said toilet seat, said disinfectant unit comprising:

a housing having a lower wall and an upper wall, said lower wall being mounted to an upper surface of said bowl of said toilet having said housing being positioned against said tank, said upper wall having a blower opening extending into an interior of said housing, said upper wall having a sprayer opening extending into said interior of said housing, said sprayer comprising a cylinder being slidably positioned within said housing, said cylinder being aligned with said sprayer opening, said cylinder having an outside wall, said cylinder having a first rail gear being integrated into said outside wall, said first rail gear being vertically oriented on said outside wall, said cylinder having a sprayer inlet being integrated into said outside wall and a sprayer outlet being integrated into said outside wall, said sprayer outlet being in fluid communication with said sprayer inlet, said sprayer inlet being positioned adjacent to a lower end of said cylinder, said sprayer outlet being positioned adjacent to an upper end of said cylinder, said blower having a front wall and a lateral wall, said blower being aligned with said blower opening in said top wall of said housing, said front wall being foraminous wherein said front wall is configured to pass air through said front wall, said blower having a second rail gear being integrated into said lateral wall, said second rail gear being vertically oriented on said lateral wall, said blower including a plurality of fans each being positioned within said blower wherein each of said plurality of fans is configured to blow air outwardly through said front wall when said fans are turned on;

a processor being integrated into said housing, said processor receiving a blower deploy input and a blower retract input and a sprayer deploy input and a sprayer retract input;

an electronic timer being integrated into said housing, said electronic timer being electrically coupled to said processor, said electronic timer being actuated to countdown a first duration of time when said processor receives said sprayer deploy input, said processor receiving said sprayer retract input when said electronic timer completes counting down said first duration of time, said electronic timer being actuated to countdown a second duration of time when said processor receives said blower deploy input, said processor receiving said blower deploy input when said electronic timer finishes counting down said first duration of time, said processor receiving said blower retract input when said electronic timer finished counting down said second duration of time;

a first motor being positioned within said housing, said first motor being electrically coupled to said processor, said first motor being positioned adjacent to said cylinder associated with said sprayer, said first motor being actuated to rotate in a first direction when said processor receives said sprayer deploy input, said first motor being actuated to rotate in a second direction when said processor receives said sprayer retract input;

a first gear being rotatably attached to said first motor, said first gear enmeshing with said first rail gear which is integrated into said cylinder, said cylinder being lifted upwardly through said sprayer opening in said upper wall of said housing when said first motor rotates in said first direction, said cylinder being lowered through said sprayer opening having said cylinder being contained within said housing when said first motor rotates in said second direction;

a second motor being positioned within said housing, said second motor being electrically coupled to said processor, said second motor being positioned adjacent to said lateral wall of said blower, said second motor being actuated to rotate in a second direction when said processor receives said blower deploy input, said second motor being actuated to rotate in a second direction when said processor receives said blower retract input;

a second gear being rotatably attached to said second motor, said second gear enmeshing with said second rail gear which is integrated into said lateral wall of said blower, said blower being lifted upwardly through said blower opening in said upper wall of said housing when said second motor rotates in said second direction, said blower being lowered through said blower opening having said blower being contained within said housing when said second motor rotates in said second direction, each of said plurality of fans in said blower being turned on when said processor receives said blower deploy input, each of said plurality of fans being turned off when said processor receives said blower retract input;

a pump being positioned within said housing, said pump being electrically coupled to said processor, said pump having an input and an output, said input being fluidly coupled to said outlet tube of said disinfectant reservoir such that said pump receives said liquid disinfectant, said output being fluidly coupled to said sprayer inlet on said cylinder associated with said sprayer, said pump being actuated when said processor receives said sprayer deploy input such that said pump urges said liquid disinfectant outwardly through said sprayer outlet in said cylinder associated with said sprayer, said sprayer outlet being directed toward said seat of said toilet when said cylinder associated with said sprayer is cylinder is lifted upwardly thereby facilitating said sprayer outlet to spray said liquid disinfectant onto said toilet seat, said pump being de-actuated when said processor receives said sprayer retract input; and a power supply being positioned within said housing, said power supply being electrically coupled to said processor, said power supply comprising at least one battery; and a flush sensor being mountable to a toilet having said flush sensor being positioned in a bowl of said toilet thereby facilitating said flush sensor to be exposed to water when said toilet is flushed, said flush sensor including a conductor being electrically coupled between said flush sensor and said processor in said housing associated with said disinfectant unit, said flush sensor resting against in interior surface of said bowl, said processor receiving said sprayer deploy input when said flush sensor senses water.

11. The assembly according to claim 10, wherein:

said disinfectant reservoir is a unitary structure of said tank of said toilet; and said assembly includes a spray tube being continuous such that said spray tube defines a closed loop, said spray tube being positioned on an interior surface of said bowl having said spray tube extending around a full perimeter of said interior surface;

said spray tube has a plurality of spray nozzles being distributed around a full perimeter of said spray tube, said spray tube being oriented such that each of said spray nozzles is directed into an interior of said bowl; and said spray tube includes a supply tube that is fluidly coupled between said spray tube and said output of said pump thereby facilitating said spray tube to spray said liquid disinfectant into said bowl when said pump is turned on.

* * * * *